US010001740B2

(12) United States Patent
Ohtoshi et al.

(10) Patent No.: US 10,001,740 B2
(45) Date of Patent: Jun. 19, 2018

(54) CURL CORRECTING APPARATUS AND IMAGE FORMING APPARATUS

(71) Applicant: Sharp Kabushiki Kaisha, Osaka (JP)

(72) Inventors: Takenori Ohtoshi, Osaka (JP); Yoshitaka Matsumoto, Osaka (JP); Sohichi Takata, Osaka (JP); Junya Masuda, Osaka (JP); Yoshiharu Yoneda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days. days.

(21) Appl. No.: 15/208,097

(22) Filed: Jul. 12, 2016

(65) Prior Publication Data

US 2017/0017188 A1 Jan. 19, 2017

(30) Foreign Application Priority Data

Jul. 16, 2015 (JP) ..... 2015-142029
May 23, 2016 (JP) ..... 2016-102235

(51) Int. Cl.
*G03G 15/00* (2006.01)

(52) U.S. Cl.
CPC ..... *G03G 15/6576* (2013.01); *G03G 2215/00662* (2013.01)

(58) Field of Classification Search
CPC ..... G03G 15/6576
USPC ..... 399/406
See application file for complete search history.

(56) References Cited

U.S. PATENT DOCUMENTS 4,787,616 A * 11/1988 Sasaki ..... B65H 39/11 271/176
5,017,970 A * 5/1991 Sakata ..... G03G 15/206 162/271
5,565,971 A * 10/1996 Kuo ..... B65H 29/12 162/197
5,848,347 A * 12/1998 Kuo ..... B65H 29/12 162/271
6,259,888 B1 * 7/2001 Kazama ..... B65H 29/12 271/183
6,375,181 B1 * 4/2002 Kawano ..... B65H 29/58 270/58.12
8,688,019 B2 * 4/2014 Nagata ..... G03G 15/206 399/322
2008/0304887 A1 * 12/2008 Horie ..... G03G 15/6576 399/406

(Continued)

FOREIGN PATENT DOCUMENTS

JP 2010-132368 A 6/2010

*Primary Examiner* — Anthony Nguyen
(74) *Attorney, Agent, or Firm* — Renner Otto Boisselle & Sklar, LLP

(57) ABSTRACT

A curl correcting apparatus includes rollers, a motor, and a clutch portion. The rollers are curl correction-use rollers which are arranged in parallel to each other in a pressure-contact state and which are different in hardness. The motor is a motor capable of rotating in forward and reverse directions relative to a correction-amount adjusting portion that changes and adjusts a distance to the rollers as a result of an eccentric cam that integrally rotates in accordance with a rotation amount of a rotation shaft, pressing against the rollers. The clutch portion transmits a rotary driving force of the motor to the rollers during the forward rotation and to a rotation shaft during the reverse rotation.

8 Claims, 13 Drawing Sheets

(56) References Cited

U.S. PATENT DOCUMENTS

| | | | | |
|---|---|---|---|---|
| 2009/0003912 | A1* | 1/2009 | Nagasaki | G03G 15/6576 399/406 |
| 2009/0190983 | A1* | 7/2009 | Yamamoto | B65H 29/12 399/406 |
| 2010/0135708 | A1 | 6/2010 | Goto | |
| 2011/0142517 | A1* | 6/2011 | Kanai | G03G 15/6576 399/406 |
| 2011/0142518 | A1* | 6/2011 | Nishida | G03G 15/6576 399/406 |
| 2014/0140746 | A1* | 5/2014 | Egawa | G03G 15/6576 399/406 |

* cited by examiner

DURING RECORDING PAPER TRANSPORTATION

DURING CURL CORRECTING AMOUNT ADJUSTMENT

DURING RECORDING PAPER TRANSPORTATION

DURING CURL CORRECTING AMOUNT ADJUSTMENT

CURL CORRECTING APPARATUS AND IMAGE FORMING APPARATUS

CROSS REFERENCE OF RELATED APPLICATION

The disclosures of Japanese patent application No. 2015-142029 filed on Jul. 16, 2015 and Japanese patent application No. 2016-102235 filed on May 23, 2016 are incorporated by reference.

BACKGROUND OF THE INVENTION

Field of the Invention

The present invention relates to a curl correcting apparatus that corrects a curl generated in a recording paper and relates also to an image forming apparatus.

Description of the Related Art

It is known that as a result of toner being contracted after a fixation, a recording paper fixed in a heated and pressured state is curled and distorted. The curl causes a paper jam in a paper transporting path, and a post-processing portion that processes the recording paper in a stacking state may not be capable of performing a good post-process. Further, it is known that the curling differs in amount also depending on a material and the like of the recording paper.

One example of a related art is disclosed in Japanese patent application laying-open No. 2010-132368 [B65H 29/70] (Literature 1) laid-open on Jun. 17, 2010. A curl correcting apparatus disclosed in this Literature 1 corrects curl and is provided with a curl-correction-amount adjusting mechanism. More specifically, the curl correcting apparatus is arranged along a paper transporting path from an image forming apparatus to a post-processing apparatus, and has a roller made of sponge and a roller made of metal facing each other in a pressure-contact state. Further, the curl-correction-amount adjusting mechanism causes a dedicated curl-correction-amount adjusting motor to drive to thereby move the roller made of sponge in a pressure-contact direction toward and away from the roller made of metal, whereby a curl correction amount is adjusted.

In the curl correcting apparatus disclosed in this Literature 1, one of the roller made of sponge and the roller made of metal arranged, as a curl correction-use, to face each other is driven to be rotated by a recording paper transportation-use motor so that a recording paper is also transported. Therefore, the curl correcting apparatus is provided with the recording paper transportation-use motor and the curl-correction-amount adjusting motor, and as a result, the apparatus becomes large in size and a cost increases.

SUMMARY OF THE INVENTION

The present invention has been achieved in view of the foregoing, and an object thereof is to provide a curl correcting apparatus and an image forming apparatus with which it is possible to enable, with a single rotary driving portion, transportation of recording paper and adjustment of a curl correction amount.

The present invention includes: a curl correcting portion that has a first roller and a second roller which are arranged in parallel to each other in a pressure-contact state and which are different in hardness; an adjusting portion that includes an adjustment rotation shaft having an abutting portion and that adjusts a distance to the first roller as a result of the abutting portion pressing against, in accordance with a rotation amount of the adjustment rotation shaft, the second roller; a rotary driving portion capable of rotating in forward and reverse directions; and a clutch portion that transmits a rotary driving force of the rotary driving portion to the first roller during the forward rotation and to the adjustment rotation shaft during the reverse rotation.

It is possible to appropriately correct a curl generated in a recording paper by adjusting a setting of a curl correction amount. The curl amount differs depending on a material or a type of the recording paper, and thus, it is preferable to adjust the curl correction amount in accordance with the curl amount. The curl is corrected by passing the recording paper between a pair of pressure-contacted rollers different in hardness, and further, the curl correction amount is made adjustable by adjusting the pressure-contact state of the pair of rollers, that is, a distance between rotation shafts of the pair of rollers. It is noted that a distance between the pair of rollers may be adjusted. This results in an operation where the transportation of the recording paper and the adjustment operation of the curl correction amount are performed with a single rotary driving portion. When adjusting a relative distance between the rotation shaft of the second roller and the rotation shaft of the first roller, out of the pair of the first roller and the second roller, a driving force of the rotary driving portion is transmitted to the first roller, by the clutch portion, to be driven during a forward rotation, that is, the relative distance remains unchanged, resulting in an exclusive transported state, and on the other hand, the driving force of the rotary driving portion is transmitted to the adjustment rotation shaft during a reverse rotation, and the relative distance is changed and adjusted. Therefore, with a single rotary driving portion, the transportation of the recording paper, the curl correcting operation, and the adjustment operation of the curl correction amount are made possible, and as a result, it is possible to achieve space-saving and also possible to provide a reasonably priced apparatus.

Further, it is characterized in that the abutting portion of the adjusting portion includes an eccentric cam. According to the configuration, it is possible to perform adjustment by rotating the adjustment rotation shaft.

Further, the second roller is supported by a transportation guiding portion, and it is characterized in that the adjusting portion adjusts a distance to the second roller via the transportation guiding portion. According to the configuration, integration with a transporting guide enables ensuring of a constant smooth transportation even when a relative position of the first roller and the second roller is changed while reducing a change as much as possible in transportation path of the recording paper.

Further, it is characterized in that the hardness of the first roller is lower than the hardness of the second roller. According to the configuration, a nip portion is provided between the pair of rollers, and therefore, when the distance between the rotation shafts of the pair of rollers is adjusted, it is possible to adjust a nip pressure, that is, a correcting pressure.

Further, the adjustment rotation shaft is provided with a detection piece that rotates together with the adjustment rotation shaft, and it is characterized in further including: an optical sensor; and a rotation amount control means that detects, on the basis of output of the optical sensor, whether there is at least the detection piece to control a rotation amount of the adjustment rotation shaft. The rotation amount of the adjustment rotation shaft is controlled by using the optical sensor, and thus, it is possible with a simple configuration to appropriately adjust the correcting pressure in accordance with a thickness and the like of the recording paper.

Further, the clutch portion is provided with a first one-way clutch and a second one-way clutch, and it is characterized in that in the first one-way clutch, a first input shaft is linked to the rotary driving portion, a first output shaft is linked to the first roller, in the second one-way clutch, a second input shaft is linked to the first input shaft, and a second output shaft is linked to the adjustment rotation shaft. According to the configuration, by the two one-way clutches, it is possible to adjust the curl correction amount in a light load state where the first roller and another transporting roller for transporting the recording paper are stopped from rotating.

Further, the clutch portion includes a one-way clutch, and it is characterized in that in the one-way clutch, an input shaft is linked to the rotary driving portion and an output shaft is linked to the adjustment rotation shaft. Even when one direction clutch is used, it is possible with a single rotary driving portion to enable the transportation of the recording paper, the curl correcting operation, and the adjustment operation of the curl correction amount.

Further, an image forming apparatus according to the present invention is provided with the curl correcting apparatus, and a drive controlling portion that rotates forwardly the rotary driving portion during transportation of a recording paper and rotates reversely the rotary driving portion during curl correction-amount adjustment. According to the configuration, it is possible to provide an image forming apparatus capable of adjusting the curl correction amount.

The above described objects and other objects, features, and advantages of the present invention will become more apparent from the following detailed description of the present invention when taken in conjunction with the accompanying drawings.

BRIEF DESCRIPTION OF THE DRAWINGS

FIG. 10A shows a movement of each portion during transportation, and FIG. 10B shows a movement of each portion during adjustment.

FIG. 12A shows a movement of each portion during transportation, and FIG. 12B shows a movement of each portion during adjustment.

DETAILED DESCRIPTION OF NON-LIMITING EXAMPLE EMBODIMENTS

[First Embodiment]

Figure 1:
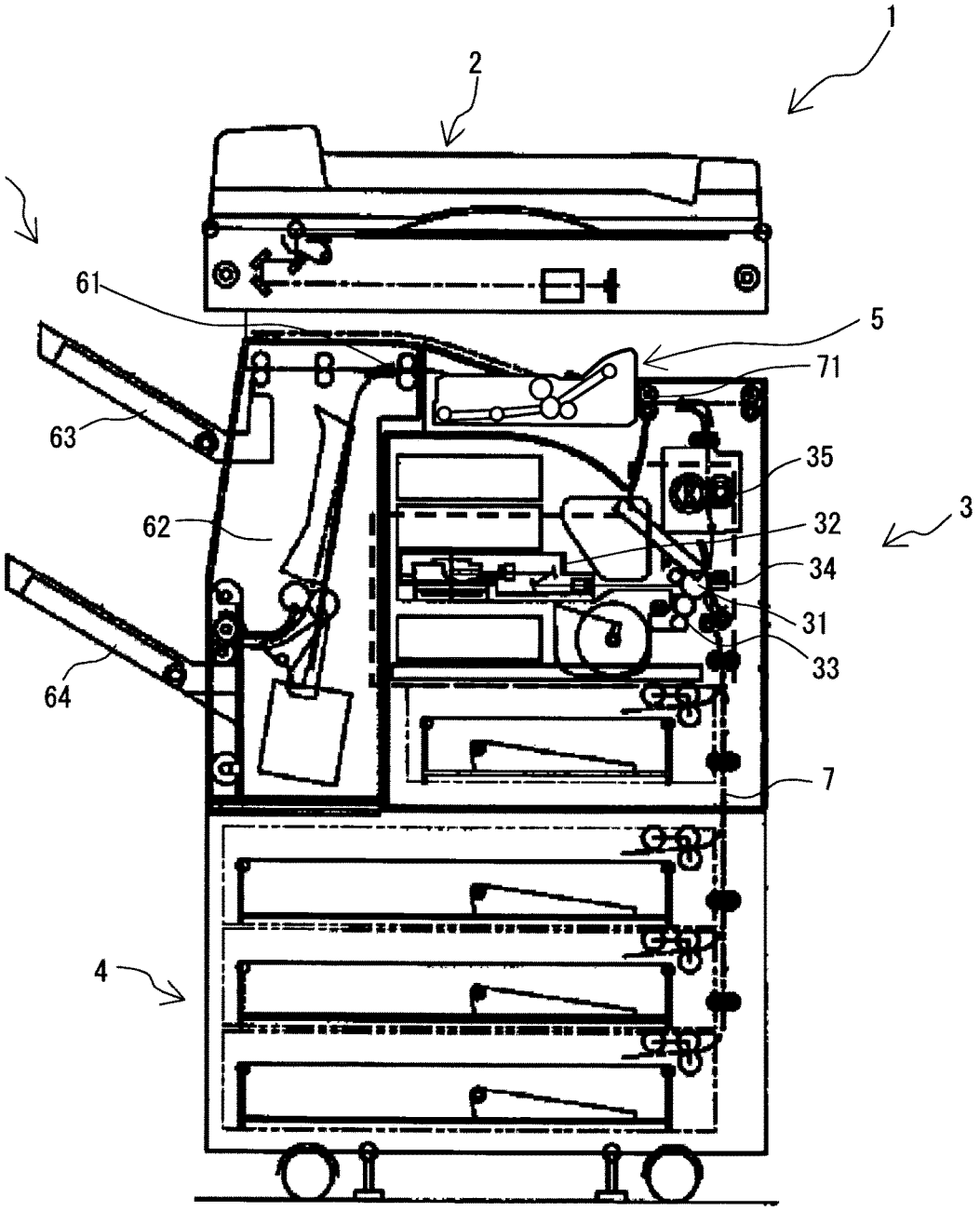
FIG. 1 is a lateral cross-sectional view showing a configuration of an image forming apparatus to which a curl correcting apparatus according to the present invention is applied.

As shown in FIG. 1, in a main boy upper portion of an image forming apparatus 1, a scanner device 2 that reads an image of an original to generate image data is mounted, and in a main body thereof, there are provided: an image forming unit 3 that executes an image forming process on a recording paper; a paper feeding unit 4 that feeds the recording paper to the image forming unit 3; a relay transporting unit 5 that guides the recording paper to a post-processing unit 6, while correcting a curl of the recording paper that passes through the image forming unit 3; and the post-processing unit 6 that executes a post process on the recording paper on which the image forming process is performed. Further, the image forming apparatus 1 is provided with a paper transporting path 7 configured by: a transporting guide and a transporting roller group that transport the recording paper from the paper feeding unit 4 to the relay transporting unit 5.

The image forming unit 3 is provided with a photosensitive drum 31 rotating at a constant speed, and around the photosensitive drum 31, from a rotation-direction upstream side, an exposure position 32, a developing portion 33, a transfer portion 34, and the like are arranged. The image forming unit 3 is provided with a fixing portion 35 at a paper-transporting-direction downstream side of the transfer portion 34. The fixing portion 35 is provided with a heating roller and a pressuring roller that hold the recording paper therebetween, and heats and fuses a toner image transferred onto the recording paper to be fixed onto the recording paper. At the paper-transporting-direction downstream side of the fixing portion 35, a transportation roller 71 that transports the recording paper to the relay transporting unit 5 is provided.

The paper feeding unit 4 is provided with a paper-feeding cassette, which preferably is plural, which accommodates a recording paper different in type (such as size, thickness, and basis weight). Each paper-feeding cassette is arranged to correspond to a paper-feeding mechanism that feeds the recording paper, one by one, to the paper transporting path 7.

The relay transporting unit 5 performs a curl correcting process on an input recording paper which is then output to the post-processing unit 6, and functions as a curl correcting apparatus. A configuration of the relay transporting unit (curl correcting apparatus) 5 will be described later.

The post-processing unit 6 is provided with a switching portion 61 that switches a transporting direction of the recording paper input from the relay transporting unit 5, a staple tray 62, which is an example of the post-process, and a paper-receiving tray 63 and a paper-receiving tray 64. The post-processing unit 6 discharges the recording paper directly to the paper-receiving tray 63, or guides the recording paper to the staple tray 62, in response to the switching portion 61. The recording paper on which a staple process is performed is discharged to the paper-receiving tray 64. It is noted that a sort processing portion, a punch processing portion, and the like, which are well known as the post-processing portion, may be included.

Next, by using FIG. 2 to FIG. 10, the curl correcting apparatus 5 will be described. The curl correcting apparatus 5 includes, inside a main body 5A having both side surfaces in a widthwise direction, two lower-surface-side transporting guides 501, 502 (see FIG. 2) arranged side by side from an upstream side (the right in FIG. 2) in the paper-transporting direction toward a downstream side (the left in FIG. 2). It is noted that upper-surface-side transporting guides facing the lower-surface-side transporting guides 501, 502 are omitted from FIG. 2 for the sake of an illustration of an internal structure. In the lower-surface-side transporting guides 501, 502, a required number of transporting rollers 511, 512 are each disposed, along a transporting direction, symmetrically in a direction orthogonal to a paper transporting direction (hereinafter, widthwise direction), where the transporting rollers 511, 512 are each partially exposed from a top surface. It is noted that as partially seen in FIG. 3, in an upper-surface-side transporting guide facing the transporting rollers 511, 512, a driven roller is arranged. Further, in FIG. 1, the paper transporting direction in the curl correcting apparatus 5 is a direction from right to left, and the widthwise direction is a direction vertical to the sheet of FIG. 1.

Figure 3:
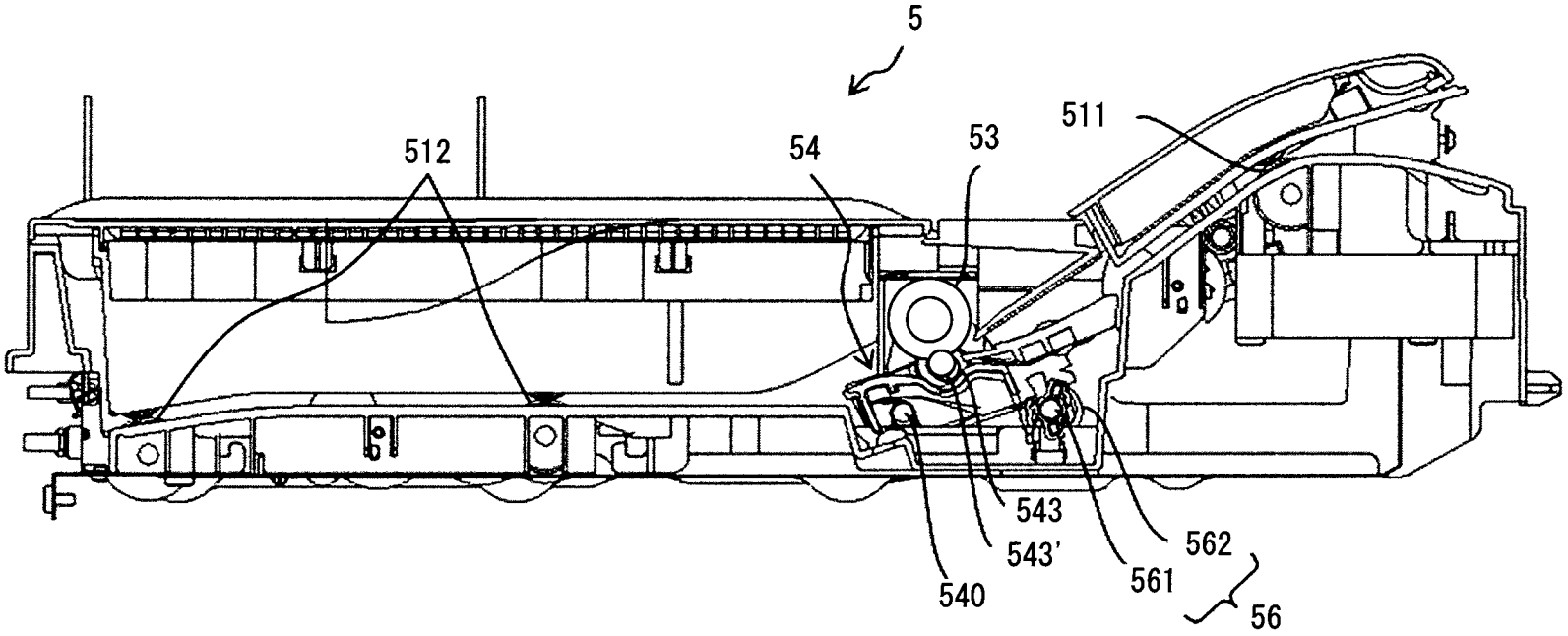
FIG. 3 is a lateral cross-sectional view showing a transportation system of the curl correcting apparatus according to the first embodiment.

At a substantially center position between the upstream side and the downstream side, a roller 53 and a roller 543 (see FIG. 3) for correcting a curl respectively different in hardness are arranged, in a pressure-contact state, in parallel to each other. The roller 53 is formed of a material of which the surface is relatively easily deformable, for example, sponge or the like, and the roller 543 is formed of a material of which the surface is relatively hard, for example, metal or the like. When the recording paper is pressed against a roller 53 side of the sponge deformed by pressure contact while passing between the roller 53 and the roller 543, the curl generated after being fixed is corrected. It is noted that as described later, a distance between the roller 53 and the roller 543 is set adjustable. Strictly speaking, a distance between a rotation shaft of the roller 53 and a rotation shaft of the roller 543 is adjustable. In FIG. 3, it is shown that a roller 543' is in a state of being adjusted to a position closer to the roller 53.

Figure 4:
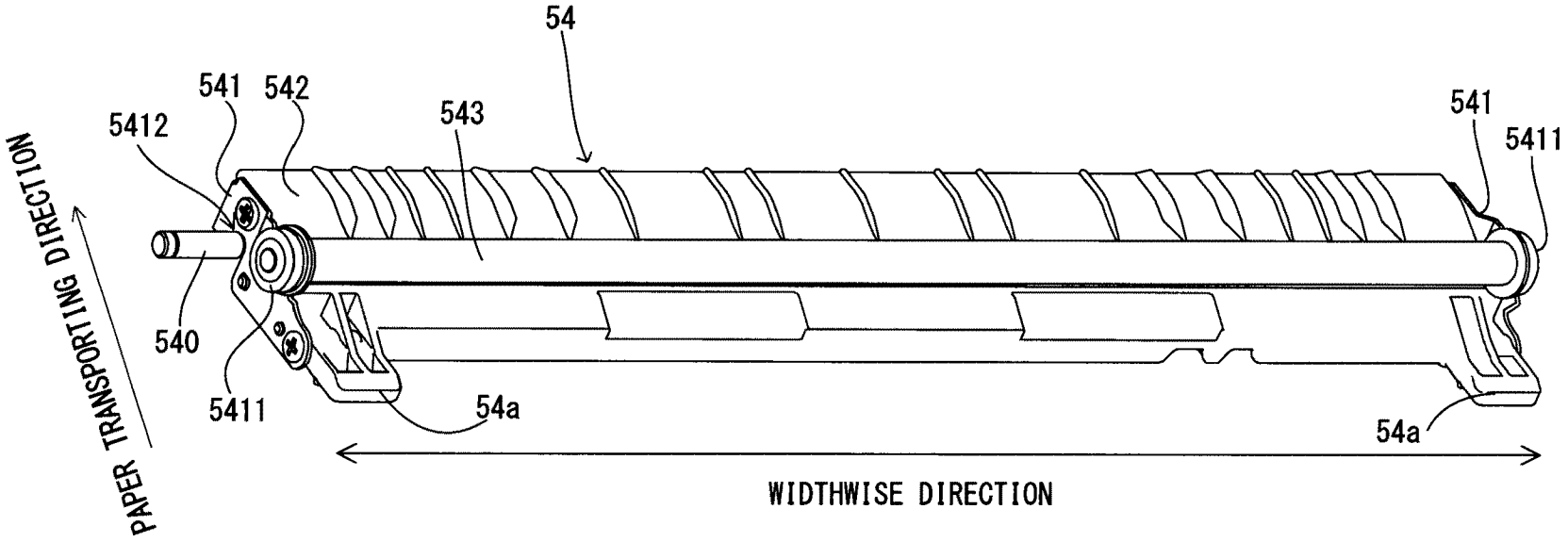
FIG. 4 is a perspective view describing a structure of a guiding member.

The roller 543 is supported by a guiding member 54, as shown in FIG. 4. The guiding member 54 has side plates 541 at widthwise both sides, and between the both side plates 541, a long guide surface portion 542 is supported. The roller 543 is axially supported rotatably by bearings 5411 of the both side plates 541. The recording paper passes at an upper surface side of the roller 543 along the guide surface portion 542 to thereby be held in between with the roller 53, has the curl corrected, and receives a transporting force.

Further, the guiding member 54 has a fitting portion 5412 which is notched into a U-lettered shape and which is axially supported by a swinging shaft 540 (see also FIG. 3) erected on a side wall of the main body 5A, and is made capable of swinging around the swinging shaft 540. As a result of the swinging, the distance between the rotation shaft of the roller 543 and the rotation shaft of the roller 53 is made adjustable. When the distance between the rotation shaft of the roller 543 and the rotation shaft of the roller 53 is long, a deformation amount of the roller 53 made of sponge is small and thus the curl correcting amount (correcting force) is small, and the shorter the distance between the rotation shaft of the roller 543 and the rotation shaft of the roller 53, the larger the deformation amount of the roller 53 made of sponge, and hence, the curl correcting amount is large. That is, when the distance between the rotation shaft of the roller 543 and the rotation shaft of the roller 53 is adjusted, the correcting amount (correcting force) of the curl is adjusted. It is noted that a mode in which the roller 543 is alone moved may be possible; however, in a mode in which the roller 543 is swung together with the guiding member 54, it is possible to unfailingly guide the recording paper to a held position even in a change in distance between the rotation shaft of the roller 543 and the rotation shaft of the roller 53.

In an appropriate position of the guiding member 54, the position being opposite to the fitting portion 5412, a pair of abutting portions 54*a* are provided in the widthwise direction in the present embodiment. As described later, when an external force is effected on the abutting portion 54*a*, the swinging around the swinging shaft 540 is executed.

Figure 2:
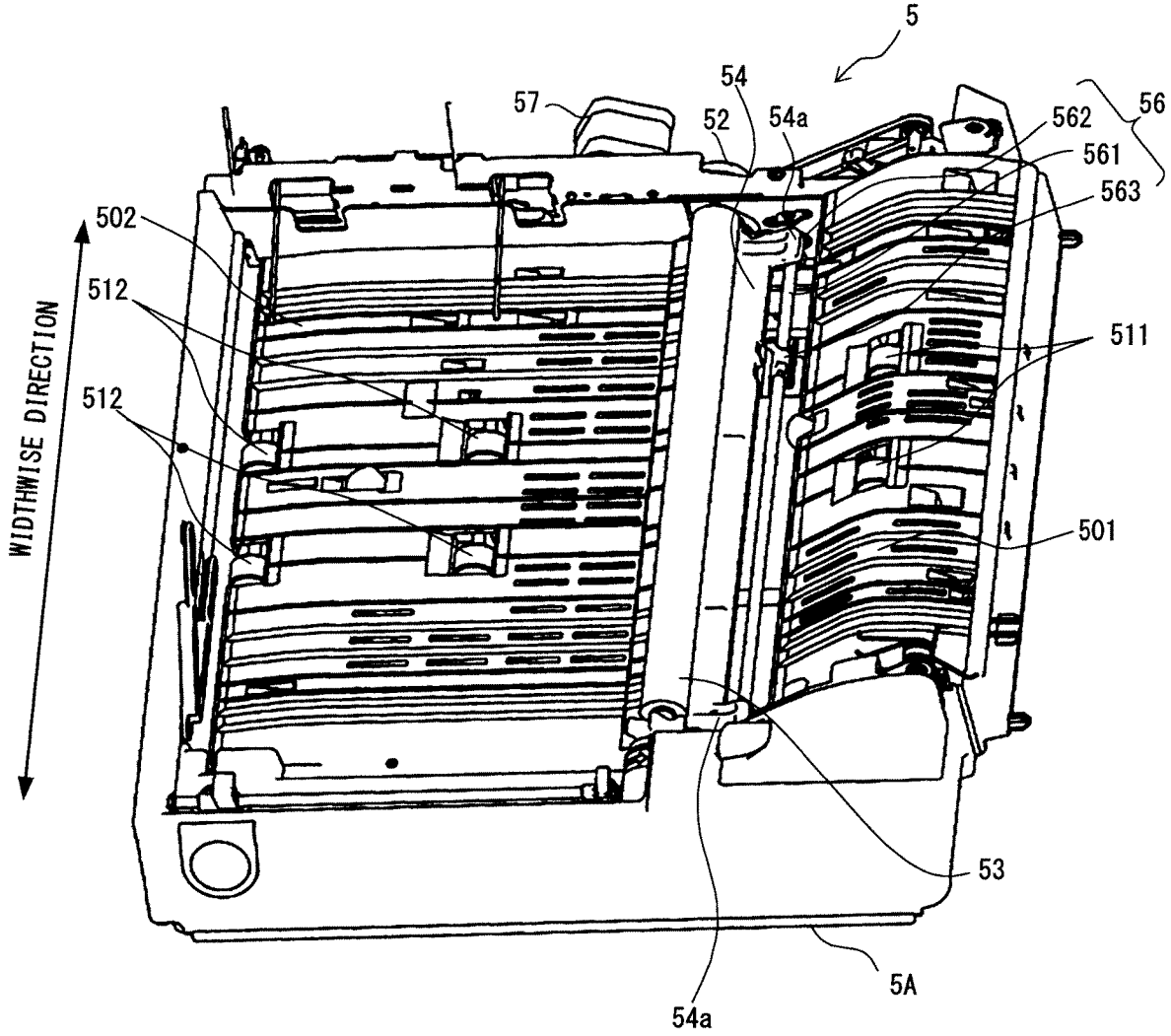
FIG. 2 is a perspective view of a curl correcting apparatus according to a first embodiment.
Figure 5:
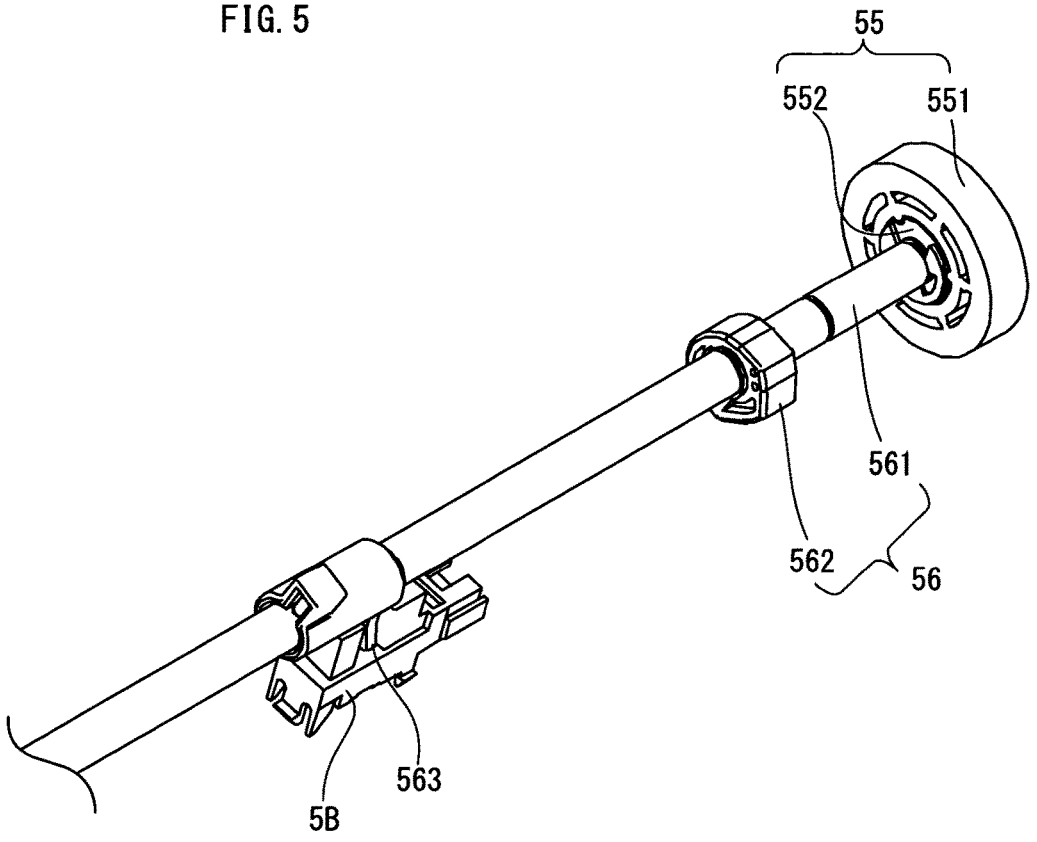
FIG. 5 is a partial perspective view of a correction-amount adjusting portion.

As shown in FIG. 2, FIG. 3, and FIG. 5, a correcting-amount adjusting portion 56 that swings the guiding member 54 is provided near the guiding member 54. The correcting-amount adjusting portion 56 is supported coaxially by a one-way clutch 55, as described later, in the present embodiment. The correcting-amount adjusting portion 56 is provided with: a rotation shaft 561 that extends in the widthwise direction and that is axially supported at both sides of the main body 5A; an eccentric cam 562 that is fixed to the rotation shaft 561 and that abuts the abutting portion 54*a* (see FIG. 5); and a detection piece 563 that is fixed to the rotation shaft 561 and that is for detecting a rotation phase, for example, a reference angle position (see FIG. 2).

In the eccentric cam 562, a distance from a rotation center is gradually changed relative to a peripheral direction, for example. In order to detect the reference angle position of the rotation shaft 561 when being detected by an optical sensor 5B (see FIG. 5, FIG. 7, and FIG. 9) and the like provided at a main body 5A side, the detection piece 563 is fixedly provided to the rotation shaft 561.

When the eccentric cam 562 swings the abutting portion 54*a* by an eccentric distance corresponding to a rotation phase position of the rotation shaft 561, in defiance of a biasing force by a spring (not shown) or the like toward a clockwise direction (FIG. 3) around the swinging shaft 540, a swinging amount of the guiding member 54, that is, a distance between the rotation shaft of the roller 543 and the rotation shaft of the roller 53, is adjusted. Therefore, when the surface of the roller 53 is deformed, a nip pressure of the nip portion between the roller 543 and the roller 53 is changed and the curl correcting amount (correcting pressure) is adjusted. However, in the image forming apparatus 1 that performs printing on the recording paper having a large thickness, the roller 543 and the roller 53 may be arranged to be separated. In such a case, not only the distance of the rotation shaft of the roller 543 relative to the rotation shaft of the roller 53 but also a distance toward and away from the roller 543 relative to the roller 53 may be adjusted. Therefore, the curl correcting amount may be adjusted by the distance toward and away from the roller 543 relative to the roller 53. When such a configuration is adopted, from a relationship between the reference angle position and the eccentric distance corresponding to the rotation phase position of the eccentric cam 562, it is possible to set the curl correcting amount according to a rotation amount from a reference (reference angle position) of the rotation shaft 561.

The detection piece 563 is fixed to a predetermined position of the rotation shaft 561 and rotates together with the rotation shaft 561. Although not easy to see from the drawings, the detection piece 563 is formed in a substantially rectangular plate shape having a width capable of shielding a sensing portion (light receiving portion) of the optical sensor 5B, and a longitudinal direction thereof is a direction extending in a radial direction from a center of the rotation shaft 561. In the first embodiment, in the reference angle position of the rotation shaft 561, the detection piece 563 is arranged so that the sensing portion of the optical sensor 5B is shielded.

For example, the optical sensor 5B is a transmissive optical sensor, and light irradiated from a light emitting portion is received by a light receiving portion. Therefore, the thickness of the detection piece 563 is set smaller than an interval between the light emitting portion and the light receiving portion. However, when the light receiving portion is shielded by the detection piece 563, the light irradiated from the light emitting portion is not received by the light receiving portion. Therefore, by a change in light received by the light receiving portion, output of the optical sensor 5B is changed.

It is noted that although a detailed description is omitted, as the optical sensor 5B, a reflective optical sensor may also be used. In such a case, when the detection piece 563 is located at a position corresponding to the light emitting portion and the light receiving portion, reflected light is detected by the light receiving portion, for example.

Figure 6A:
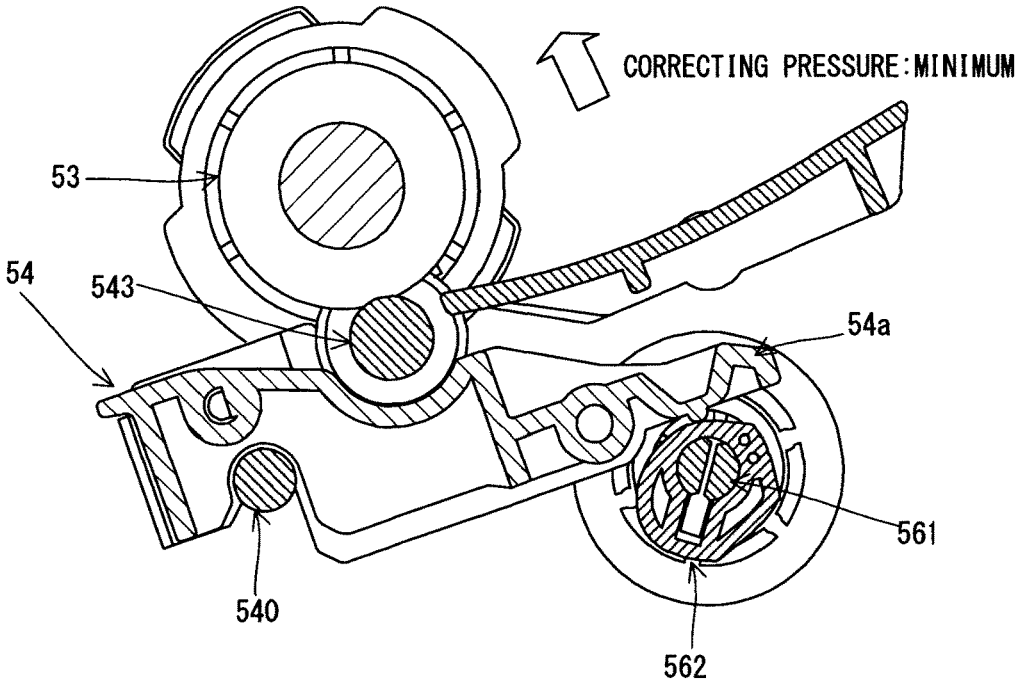
FIG. 6A is a cross-sectional view showing one example of an inclination amount of the guiding member relative to a rotation position of an eccentric cam when a correcting pressure is minimum.
Figure 6B:
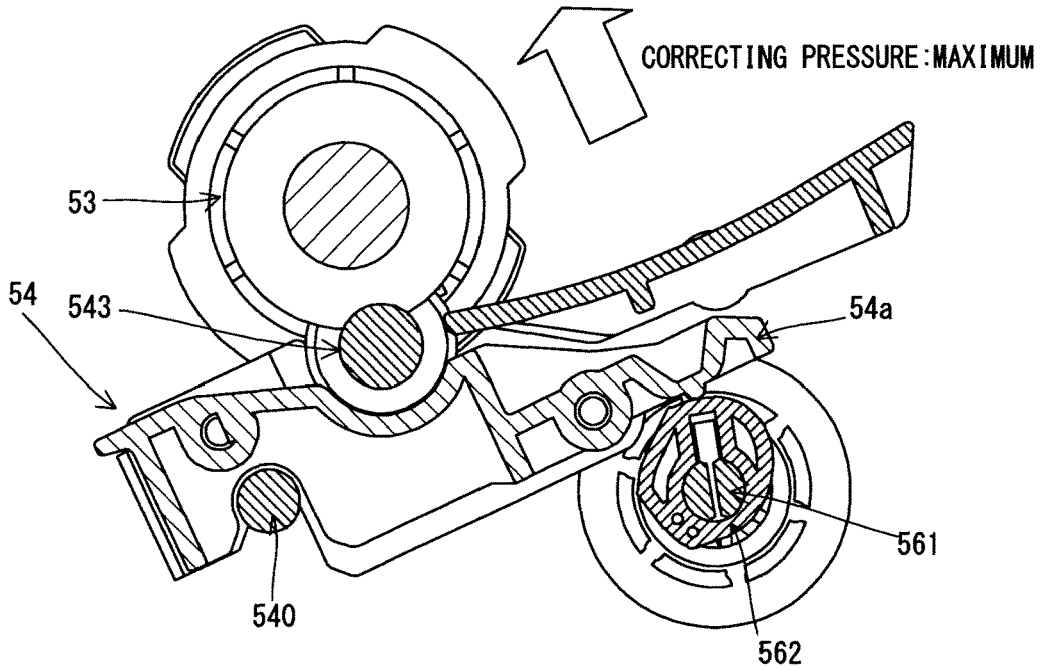
FIG. 6B is a cross-sectional view showing one example of the inclination amount of the guiding member relative to the rotation position of the eccentric cam when the correcting pressure is maximum.

FIG. 6A is a cross-sectional view showing one example of an inclination amount of the guiding member 54 relative to a rotation position of the eccentric cam 562 when a correcting pressure is minimum, and FIG. 6B is a cross-sectional view showing one example of the inclination amount of the guiding member 54 relative to the rotation position of the eccentric cam 562 when the correcting pressure is maximum. However, FIG. 6A and FIG. 6B show a cross-sectional view of a case where the eccentric cam 562 at a side not shown in FIG. 5 is cut in a direction in parallel to the paper transporting direction and vertical to the direction of the rotation shaft 561. It is noted that in FIG. 6A and FIG. 6B (same applied to FIG. 7A, and FIG. 7B), the rotation shaft of the roller 53 is shown in hatching and the hatching in a sponge portion is omitted.

As shown in FIG. 6A, when the correcting force is minimum, a distance from a center of a rotation of the eccentric cam 562 (center of the rotation shaft 561) to a position at which an outer peripheral surface of the eccentric cam 562 contacts a convex portion of the abutting portion 54*a* is the shortest. Therefore, an inclination amount (swinging) of the guiding member 54 relative to a horizontal surface is minimum, and the distance between the rotation shaft of the roller 53 and the rotation shaft of the roller 543 is the longest. However, when the correcting force is minimum, the rotation shaft 561 stops at the reference angle position. However, the convex portion is provided to downwardly protrude toward a lower surface of the abutting portion 54*a*.

On the other hand, as shown in FIG. 6B, when the correcting force is maximum, the distance from the center of a rotation of the eccentric cam 562 to the position at which the outer peripheral surface of the eccentric cam 562 contacts the convex portion of the abutting portion 54*a* is the longest. Therefore, the inclination amount of the guiding member 54 relative to the horizontal surface is maximum, and the distance between the rotation shaft of the roller 53 and the rotation shaft of the roller 543 is the shortest.

As shown in FIG. 6A and FIG. 6B, when the main body 5A of the curl correcting apparatus 5 is seen from one side (a nearer side of FIG. 2), as described later, the rotation shaft 561 is rotated (moved rotationally) in a counterclockwise direction, and the eccentric cam 562 is also rotated (moved rotationally) in accordance therewith. In accordance with a distance from the center of the rotation of the eccentric cam 562 determined at a position at which the rotation (moving rotationally) of the rotation shaft 561 is stopped, to a position at which the outer peripheral surface of the eccentric cam 562 contacts the abutting portion 54*a*, the distance between the rotation shaft of the roller 53 and the rotation shaft of the roller 543 is determined, and as a result, the correcting pressure is determined.

Figure 7A:
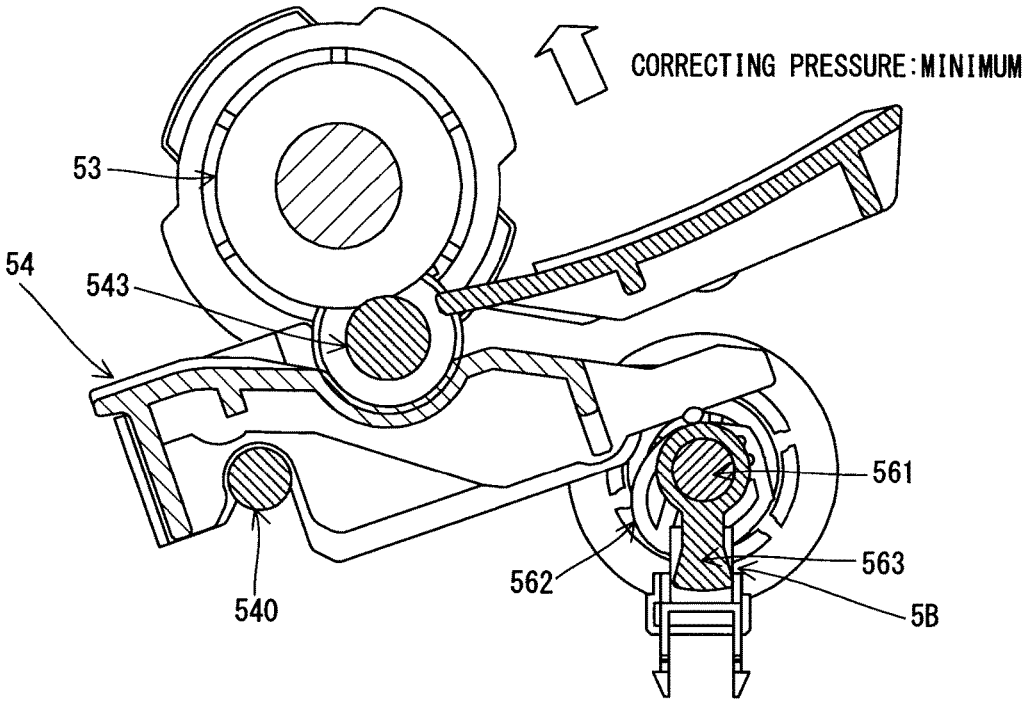
FIG. 7A is an illustrated diagram showing one example of a position of a detection piece relative to a sensing portion of an optical sensor when the correcting pressure is minimum.
Figure 7B:
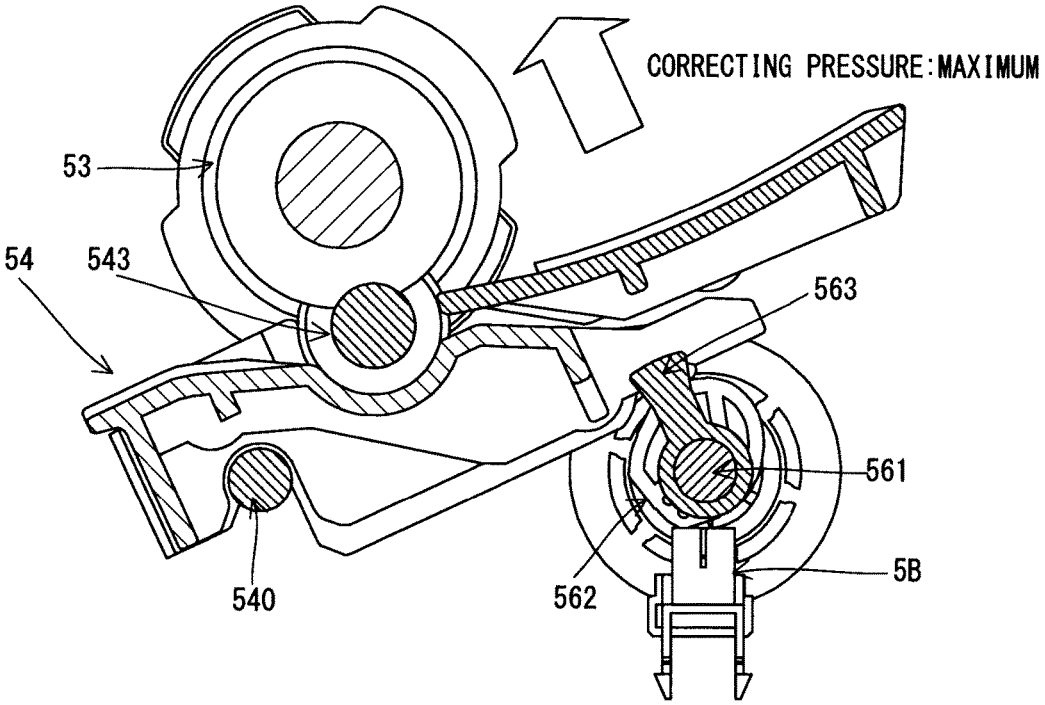
FIG. 7B is an illustrated diagram showing one example of the position of the detection piece relative to the sensing portion of the optical sensor when the correcting pressure is maximum.

FIG. 7A is an illustrated diagram showing one example of a position of the detection piece 563 relative to a sensing portion of the optical sensor 5B when the correcting pressure is minimum, and FIG. 7B is an illustrated diagram showing one example of the position of the detection piece 563 relative to the sensing portion of the optical sensor 5B when the correcting pressure is maximum. However, FIG. 7A and FIG. 7B show a cross-sectional view of a case where the detection piece 563 is cut in a direction in parallel to the paper transporting direction and vertical to the direction of the rotation shaft 561.

As shown in FIG. 7A, when the correcting pressure is minimum, the detection piece 563 is stopped at a position at which the sensing portion of the optical sensor 5B is shielded. Specifically, when the rotation shaft 561 is rotated (moved rotationally), the rotation shaft 561 arrives at the reference angle position, and then, the light from the light emitting portion of the optical sensor 5B is shielded by the detection piece 563. Thereafter, on the basis of output of the optical sensor 5B, the rotation of the rotation shaft 561 is stopped. That is, when the correcting force is set to minimum, the rotation shaft 561 may be rotated to cause the detection piece 563 to be stopped at a position at which the light receiving portion of the optical sensor 5B is shielded.

On the other hand, when the correcting pressure is maximum, as described above, the rotation shaft 561 is moved rotationally so that the distance from the center of the rotation of the eccentric cam 562 to the position at which the outer peripheral surface of the eccentric cam 562 contacts the convex portion of the abutting portion 54*a* is the longest. At this time, as shown in FIG. 7B, for example, the detection piece 563 is stopped at a position that overlaps a position at which the outer peripheral surface of the eccentric cam 562 contacts the abutting portion 54*a* (see FIG. 6B).

For example, when a rotation angle (rotationally moving amount) of the rotation shaft 561 when the correcting pressure is maximum and a correcting pressure corresponding to the rotation angle are previously measured from the reference angle position when the correcting pressure is minimum, the rotation amount of the rotation shaft 561 is controlled, whereby it is possible to adjust linearly or stepwise the correcting pressure (curl correcting amount).

The roller 53, the transporting rollers 511, 512, and the rotation shaft 561 of the correcting-amount adjusting portion 56, which form a transportation system, are rotated and driven by a motor 57, which is a single rotation drive source.

Figure 8:
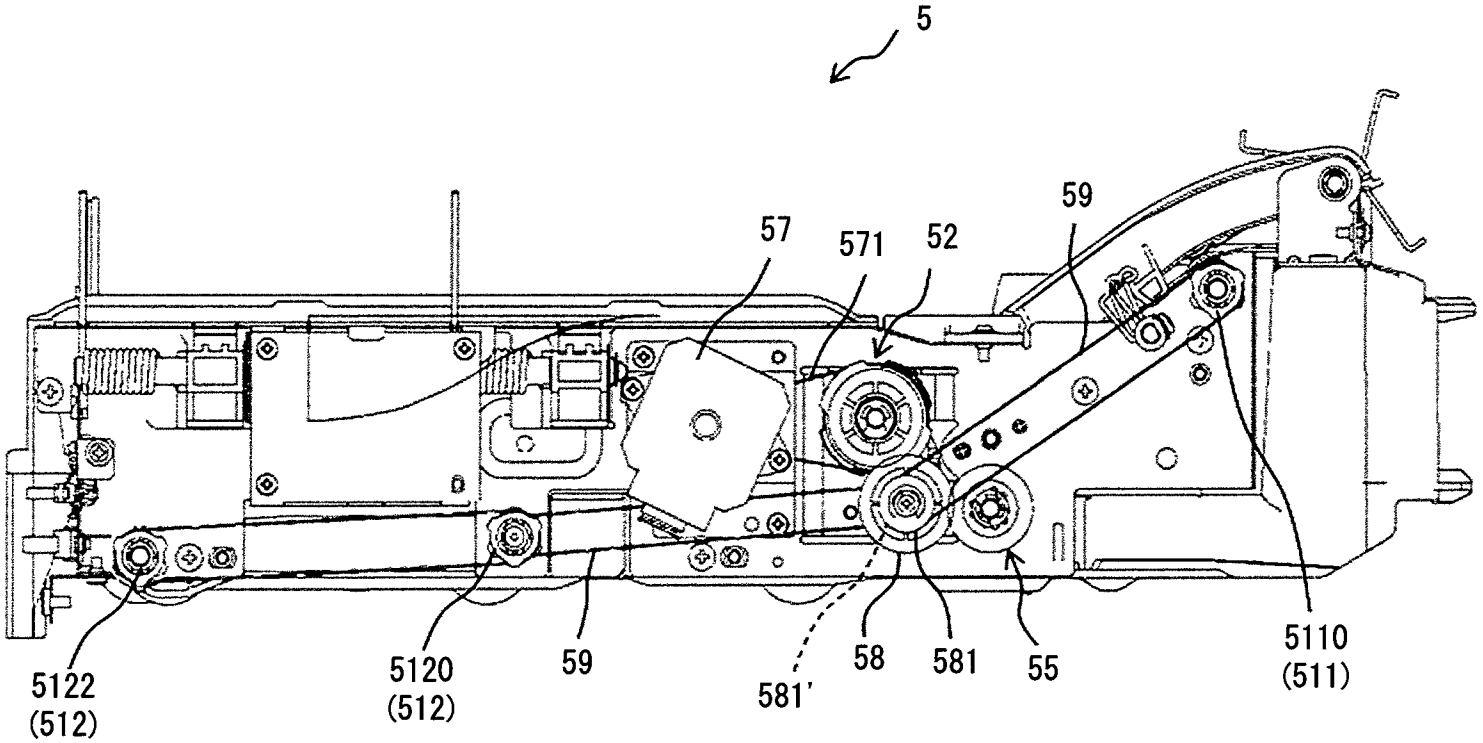
FIG. 8 is a lateral cross-sectional view showing an adjustment system of the curl correcting apparatus according to the first embodiment.
Figure 9:
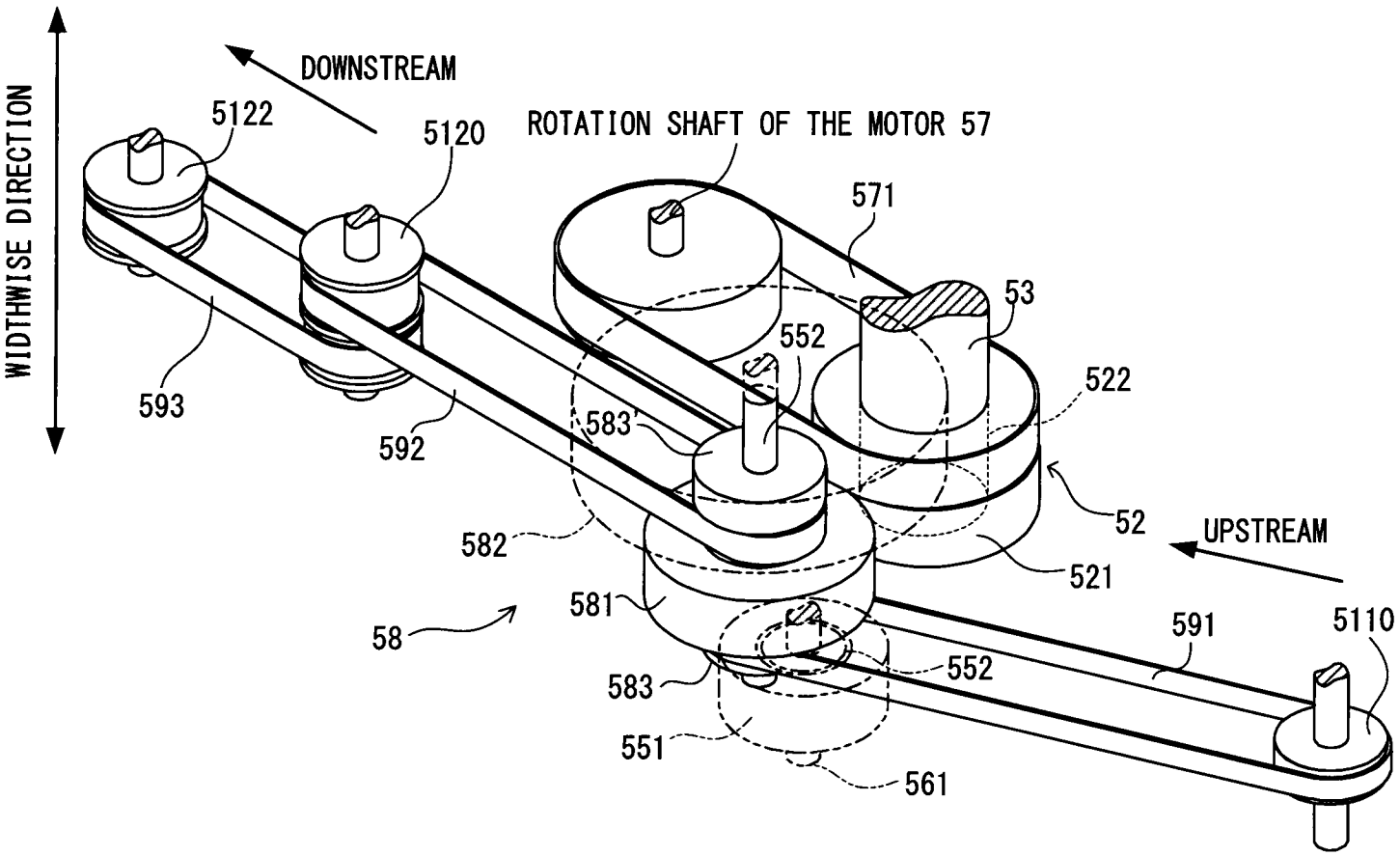
FIG. 9 is a perspective view obtained when the adjustment system of the curl correcting apparatus according to the first embodiment is seen from an obliquely downward direction.

FIG. 8 is a lateral cross-sectional view showing an adjustment system of the curl correcting apparatus 5 according to the first embodiment. FIG. 9 is a perspective view obtained when the adjustment system of the curl correcting apparatus 5 according to the first embodiment is seen from an obliquely downward direction. FIG. 10 is a simplified view showing the adjustment system of the curl correcting apparatus 5 according to the first embodiment. It is noted that FIG. 10 shows a case where the main body 5A of the curl correcting apparatus 5 is seen from one side to the other side (the farther side of FIG. 2).

In FIG. 8 to FIG. 10, among the motor 57, the roller 53, the transporting rollers 511, 512, and the rotation shaft 561, a one-way clutch mechanism is interposed. In the first embodiment, as the one-way clutch mechanism, two one-way clutches 52, 55 are provided. The one-way clutches 52, 55 each include a respectively concentric input shaft and output shaft, and as well known, when the input shaft is rotated forwardly, the output shaft is rotated together therewith, and on the other hand, when the input shaft is rotated reversely, the output shaft is not rotated (becomes static). Further, although not essential, a relay roller portion 58 is interposed. As understood from FIG. 2 and FIG. 8, the motor 57, the one-way clutches 52, 55, and the relay roller portion 58 are supported by a side wall at the other side (the farther side of FIG. 2) of main body 5A.

The one-way clutch 52 includes an input shaft 521 and an output shaft 522, and as shown in FIG. 9 and FIG. 10, the input shaft 521 is linked via a belt 571 to a roller fixed to the rotation shaft of the motor 57, and abuts a first roller 581 of the relay roller portion 58 to enable integrated rotation. It is noted that the motor 57 is omitted in FIG. 9. This applies to FIG. 11 described later.

Further, the output shaft 522 of the one-way clutch 52 is integrally joined coaxially with the curl correction-use roller 53, and abuts a second roller 582 of the relay roller portion 58. It is noted that in FIG. 10, in the one-way clutch 52, when the input shaft 521 is rotated in a clockwise direction (hereinafter, CW direction), the output shaft 522 is rotated together therewith, and when the input shaft 521 is rotated in a counterclockwise direction (hereinafter, CCW direction), the output shaft 522 is not rotated together therewith but becomes static. Further, in FIG. 9, when the second roller 582 (as well as the one-way clutch 55) is indicated by a dotted line, a roller arranged at a rear side of the second roller 582 in FIG. 9 is transmitted so as to be seen.

The relay roller portion 58 includes the first roller 581, the second roller 582, a third roller 583, and a fourth roller 583' which are respectively coaxial, and the first roller 581 and the third roller 583 are rotated integrally and separately the second roller 582 and the fourth roller 583' are rotated integrally. As well understood from FIG. 9, the first roller 581, the second roller 582, the third roller 583, and the fourth roller 583' are coaxially arranged side by side in the widthwise direction. The third roller 583 is arranged at an end of the other side in the widthwise direction of the main body 5A, and the first roller 581 formed integrally (joined integrally) with the third roller 583 is arranged inside the third roller 583. Further, inside the first roller 581, the fourth roller 583' and the second roller 582 are arranged in this order. Although difficult to see in the drawing, the third roller 583 and the first roller 581 are integrally joined, and the fourth roller 583' and the second roller 582 are integrally joined.

As shown in FIG. 9 and FIG. 10, the third roller 583 of the relay roller portion 58 is linked via a belt 591 to a roller 5110 fixed to the rotation shaft of a transporting roller 511, the fourth roller 583' of the relay roller portion 58 is linked via a belt 592 to a roller 5120 fixed to the rotation shaft of a transporting roller 512 arranged downstream of the paper transporting direction, and the roller 5120 is linked via a belt 593 to a roller 5122 fixed to the rotation shaft of another transporting roller 512 arranged further downstream of the paper transporting direction. Further, the first roller 581 of the relay roller portion 58 abuts the one-way clutch 55.

The one-way clutch 55 includes a respectively coaxial input shaft 551 and output shaft 552, and the input shaft 551 abuts the first roller 581 to enable integrated rotation and the output shaft 552 is integrally joined coaxially with the rotation shaft 561 of the correcting-amount adjusting portion 56. It is noted that in FIG. 10, in the one-way clutch 55, when the input shaft 551 is rotated in the CW direction, the output shaft 552 is not rotated together therewith, and when the input shaft 551 is rotated in the CCW direction, the output shaft 552 is rotated together therewith.

In the above configuration, now, an operation of each portion during recording paper transportation and during curl correcting amount adjustment will be described with reference to FIG. 9 and FIG. 10.

(1) During Recording Paper Transportation

Figure 10A:
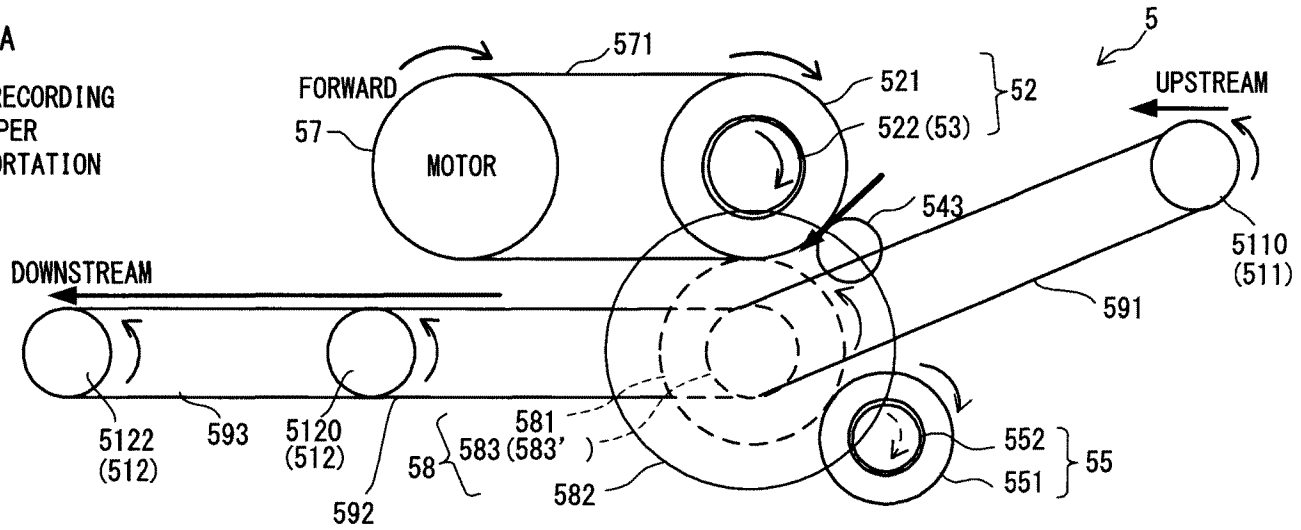
FIGS. 10A and 10B are simplified views showing the adjustment system of the curl correcting apparatus according to the first embodiment, where

As shown in FIG. 10A, when the motor 57 is rotated in the CW direction (forward direction), the input shaft 521 of the one-way clutch 52 is rotated in the CW direction, and the output shaft 522 also is rotated in the CW direction together therewith. Accordingly, when the first roller 581 and the third roller 583 are rotated, the upstream roller 5110 (transporting roller 511) is rotated in the paper transporting direction (CCW direction) as indicated by an arrow. Further, as understood also with reference to FIG. 9, when the output shaft 522 also is rotated together therewith, the roller 53 also is rotated in the CW direction, and as a result, the second roller 582 and the fourth roller 583' are rotated in the paper transporting direction (CCW direction). Further, when the fourth roller 583' is rotated, the rollers 5120, 5122 (transporting rollers 512, 512) are rotated in the paper transporting direction (CCW direction).

Further, when the rotation of the first roller 581 allows the input shaft 551 of the one-way clutch 55 to rotate in the CW direction; however, as indicated by a dotted arrow in FIG. 10A, the output shaft 552 is not rotated together therewith, and thus, the rotation shaft 561 of the correcting-amount adjusting portion 56 remains static.

Thus, when the motor 57 is rotated in the CW direction, the roller 53 and the transporting rollers 511, 512 are rotated, and at the same time, the rotation shaft 561 is in a static state and the recording paper is transported only.

(2) During Curl Correcting Amount Adjustment

Figure 10B:
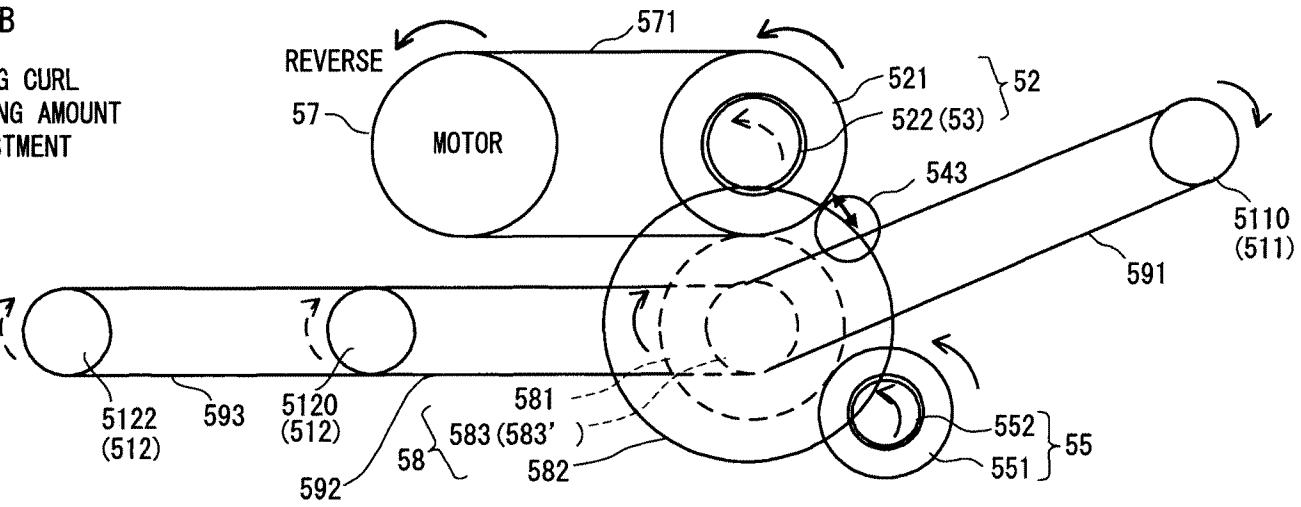

As shown in FIG. 10B, when the motor 57 is rotated in the CCW direction (reverse direction), the input shaft 521 of the one-way clutch 52 is rotated in the CCW direction, and at the same time, the output shaft 522 becomes static. Therefore, the roller 53 integrated with the output shaft 522 remains static. Further, as seen also with reference to FIG. 9, when the first roller 581 and the third roller 583 are rotated, the upstream roller 5110 (transporting roller 511) is rotated in the CW direction, and at the same time, the output shaft 522 is static and thus the second roller 582 and the fourth roller 583' are static, and the downstream rollers 5120, 5122 (transporting rollers 512, 512) are static.

Further, when the rotation of the first roller 581 allows the input shaft 551 of the one-way clutch 55 to rotate in the CCW direction, as a result, as indicated by an arrow in FIG. 10B, the output shaft 552 is rotated together therewith in the CCW direction, and thus, the rotation shaft 561 of the correcting-amount adjusting portion 56 is rotated. That is, when the rotation shaft 561 is rotated and the rotation amount is controlled, as described above, the distance between the rotation shaft of the roller 543 and the rotation amount of the roller 53 is adjusted to thereby appropriately adjust the curl correcting amount.

Thus, when the motor 57 is rotated in the CCW direction, the roller 53 and the transporting roller 512 are static (it is noted that the transporting roller 511 is rotated in the CW direction) and the rotation shaft 561 is in a state of being rotated, and as a result, it is possible to adjust the curl correcting amount by the drive amount control of the motor 57. In addition, at this time, when the driving force transmission to the roller 53 and the transporting roller 512 is blocked, a load to the motor 57 is thereby alleviated.

[Second Embodiment]

The image forming apparatus 1 according to a second embodiment is the same as the image forming apparatus 1 according to the first embodiment except for some difference in configuration and operation of the curl correcting apparatus 5, and thus, a different content from the first embodiment will be described and the overlapping content will be omitted or briefly described.

Figure 11:
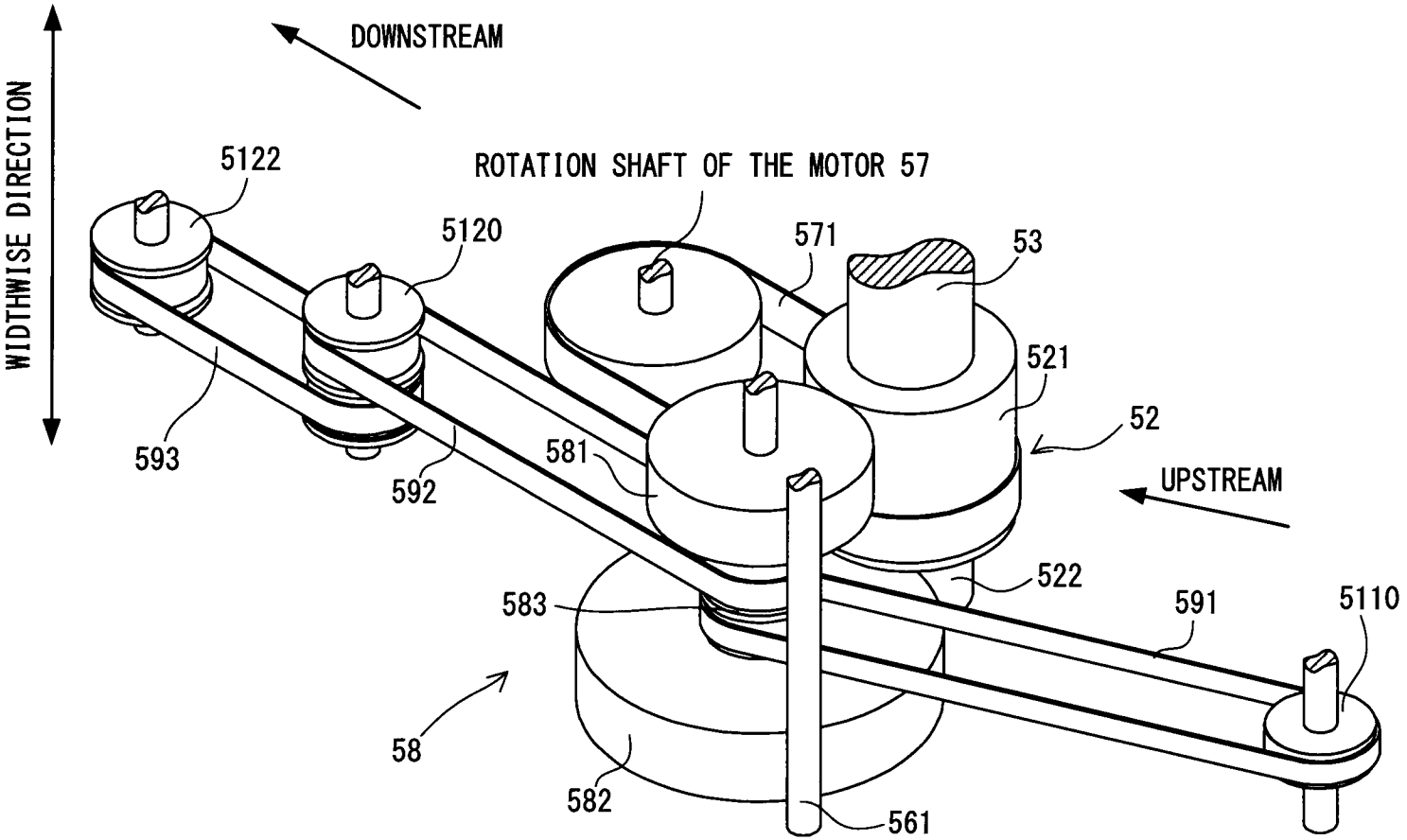
FIG. 11 is a perspective view obtained when an adjustment system of a curl correcting apparatus according to a second embodiment is seen from an obliquely downward direction.

FIG. 11 is a perspective view obtained when an adjustment system of the curl correcting apparatus 5 according to the second embodiment is seen from an obliquely downward direction. FIG. 12 is a simplified view showing the adjustment system of the curl correcting apparatus 5 according to the second embodiment.

FIG. 11 and FIG. 12 show a configuration of the curl correcting apparatus 5 according to the second embodiment, and are figures corresponding to FIG. 9 and FIG. 10 in the first embodiment. In the first embodiment, the two one-way clutches 52, 55 are adopted; however, even when the one-way clutch 52 only is used, a similar transporting operation and adjusting operation are possible. In FIG. 11 and FIG. 12, the same portions as those in FIG. 9 and FIG. 10 are assigned the same reference numerals.

In FIG. 11 and FIG. 12, a difference from FIG. 9 and FIG. 10 includes a feature that the third roller 583 is made longer in the widthwise direction (axial line direction) and the roller 5120 is linked via the belt 592 with the third roller 583. Further, the fourth roller 583' and the one-way clutch 55 are not adopted. Further, the roller 53 is integrally joined coaxially with the input shaft 521, and the output shaft 522 is extended to the other side in the widthwise direction of the main body A. Although not easily understood from the figure, the one-way clutch 52 is arranged in a reverse direction as compared to a case shown in FIG. 9 and FIG. 10. In a manner to abut the output shaft 522, the second roller 582 is arranged at the other side, relative to the third roller 583, in the widthwise direction of the main body A. Therefore, in the second embodiment, between the second roller 582 and the first roller 581, the third roller 583 is arranged. However, a feature that the first roller 581 and the third roller 583 are joined integrally is the same as in the first embodiment. Further, the rotation shaft 561 of the correcting-amount adjusting portion 56 directly abuts the second roller 582.

In the above configuration, now, an operation of each portion during the recording paper transportation and during the curl correcting amount adjustment will be described with reference to FIG. 12.

(1) During Recording Paper Transportation

Figure 12A:
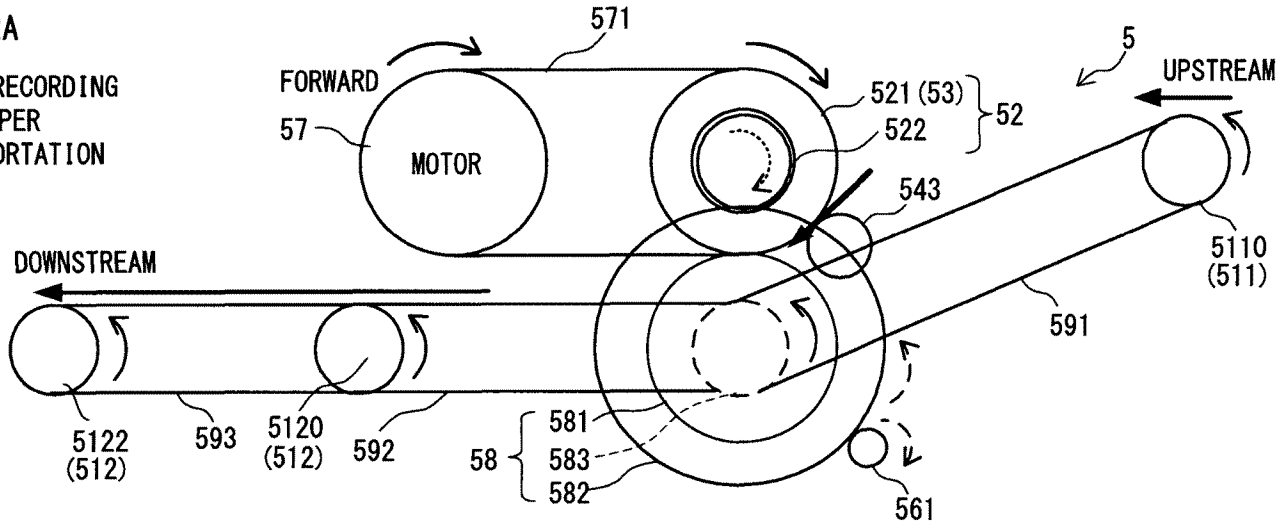
FIGS. 12A and 12B are simplified views showing the adjustment system of the curl correcting apparatus according to the second embodiment, where

As shown in FIG. 12A, when the motor 57 is rotated in the CW direction (forward direction), the input shaft 521 of the one-way clutch 52 is rotated in the CW direction, and at the same time, the output shaft 522 becomes static. Therefore, the roller 53 integrated with the input shaft 521 is rotated together therewith. Further, as understood also with reference to FIG. 11, when the input shaft 521 is rotated to allow the first roller 581 and the third roller 583 to rotate in the CCW direction, the rollers 5110, 5120, and 5122 (transporting rollers 511, 512, and 512) also are rotated in the CCW direction. On the other hand, as indicated by a dotted arrow in FIG. 12A, the output shaft 522 is static, and thus, the second roller 582 is static and the rotation shaft 561 of the correcting-amount adjusting portion 56 remains static.

Thus, when the motor 57 is rotated in the CW direction, the roller 53 and the transporting rollers 511, 512 are rotated, and at the same time, the rotation shaft 561 is in a static state and the recording paper is transported only.

(2) During Curl Correcting Amount Adjustment

Figure 12B:
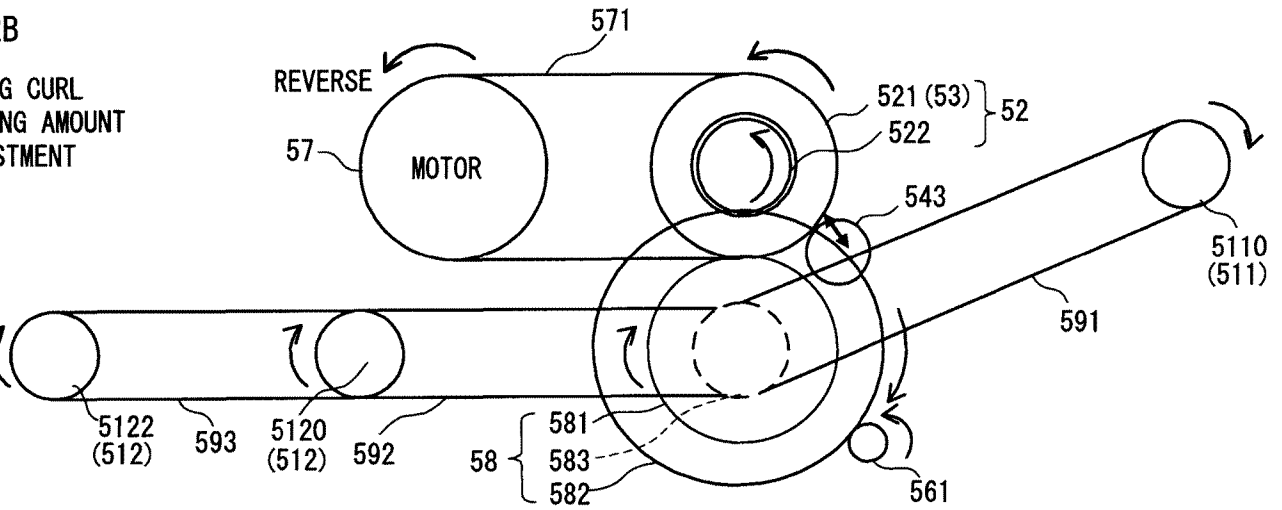

As shown in FIG. 12B, when the motor 57 is rotated in the CCW direction (reverse direction), the input shaft 521 of the one-way clutch 52 is rotated in the CCW direction, and the output shaft 522 also is rotated in the CCW direction together therewith. Therefore, the roller 53 integrated with the input shaft 521 is rotated together therewith. Further, as understood also with reference to FIG. 11, when the input shaft 521 is rotated to allow the first roller 581 and the third roller 583 to rotate in the CW direction, the rollers 5110, 5120, and 5122 (transporting rollers 511, 512, and 512) are rotated in the CW direction, as indicated by an arrow. Further, when the output shaft 522 is also rotated together therewith, the second roller 582 is rotated in the CW direction and the rotation shaft 561 of the correcting-amount adjusting portion 56 is rotated in the CCW direction.

That is, when the rotation shaft 561 is rotated and the rotation amount is controlled, as described above, the distance between the rotation shaft of the roller 543 and the rotation amount of the roller 53 is adjusted to thereby appropriately adjust the curl correcting amount.

Thus, when the motor 57 is rotated in the CCW direction, the roller 53 and the transporting rollers 511, 512 are rotated in the CW direction, and even in this state, the rotation shaft 561 is in a state of being rotated, and as a result, it is possible to adjust the curl correcting amount by the drive amount control of the motor 57.

[Third Embodiment]

In a third embodiment, an example of an electric configuration to realize adjustment of the curl correcting amount described in the first embodiment and the second embodiment will be shown.

Figure 13:
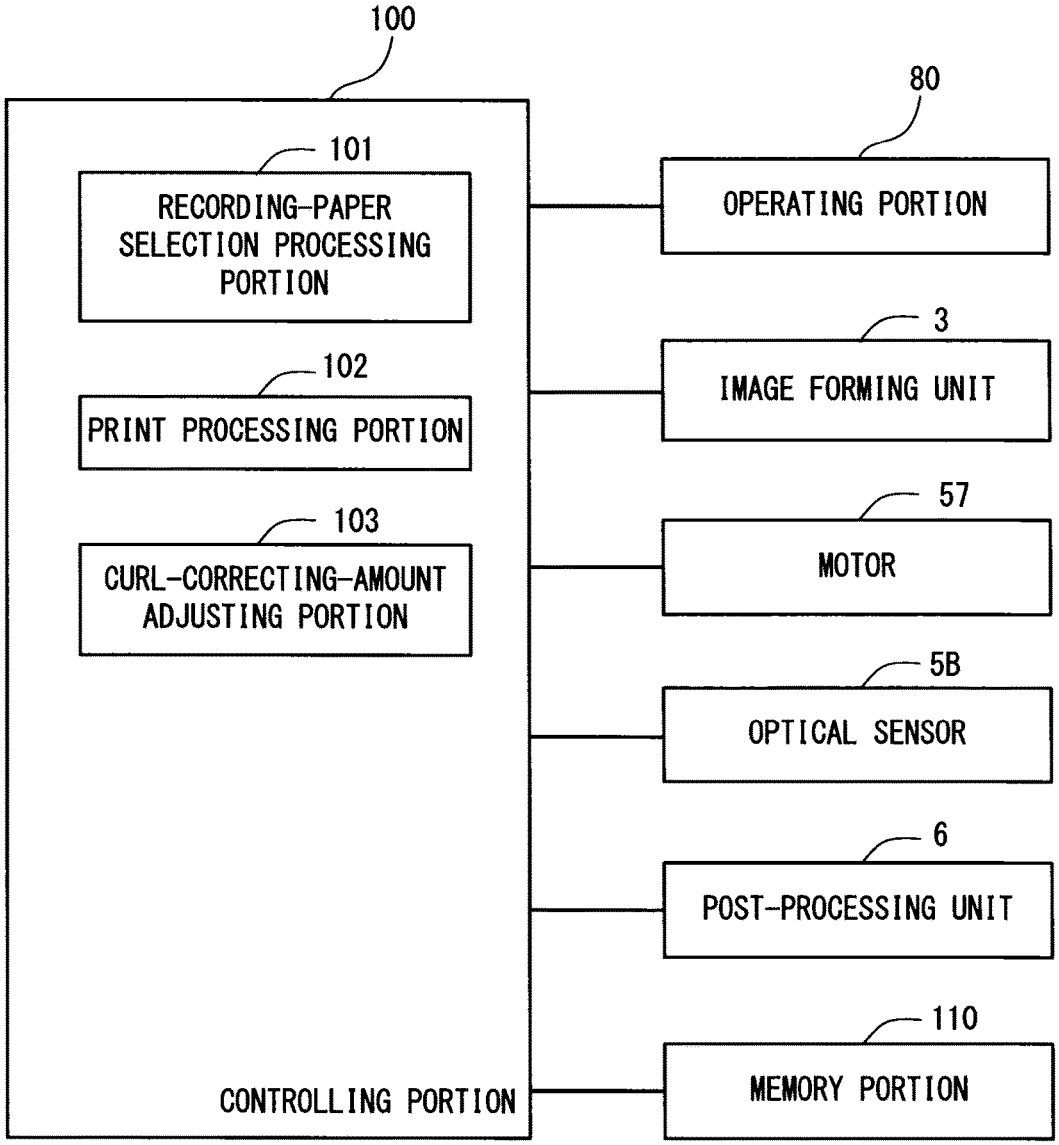
FIG. 13 is a block diagram showing adjustment control of a curl correcting apparatus according to a third embodiment.

A controlling portion 100 is to control an operation of the image forming apparatus 1, and is provided at a predetermined position within a housing of the image forming apparatus 1. The controlling portion 100 is provided with a CPU, and configured by a microcomputer or the like. As shown in FIG. 13, the controlling portion 100 is connected to an operating portion 80, such as a touch panel, capable of receiving input from outside, the image forming unit 3, the motor 57 of the relay transporting unit 5, the optical sensor 5B, the post-processing unit 6, and a memory portion 110, for example. The memory portion 110 is provided with an area which stores a control program (including a program of an adjusting process of the curl correcting amount) executed by the controlling portion 100, and a work area.

As a result of causing the CPU to execute the control program, the controlling portion 100 functions at least as a recording-paper selection processing portion 101, a print processing portion 102, and a curl-correcting-amount adjusting portion 103. The recording-paper selection processing portion 101 accepts, via the touch panel or the like, a print command, and a designation of a size and a type (such as thickness and basis weight) of the recording paper, and executes a process of selecting a corresponding paper-feeding cassette. After accepting the print command, the print processing portion 102 operates the image forming unit 3 or the like to print a predetermined image on the recording paper. At this time, the motor 57 is rotated in the CW direction to perform the curl correcting process while the recording paper is transported.

When a type of the recording paper is set by the recording-paper selection processing portion 101, the curl-correcting-amount adjusting portion 103 executes, in response to the print command, the adjusting process of the curl correcting amount corresponding to a category of the selected recording paper, before a first piece of sheet is printed. It is noted that the memory portion 110 stores therein a table showing a relationship between the category of the recording paper and the rotation amount in accordance with the curl correcting amount (rotation angle relative to the reference angle position). More specifically, the curl-correcting-amount adjusting portion 103 outputs, on the basis of a detection signal of the optical sensor 5B, a rotation drive signal for rotating the motor 57 in the CCW direction by the rotation amount by which the rotation shaft 561 is moved to a predetermined angle position. It is possible to control the rotation drive signal by a drive pulse number and/or a drive time period depending on the type of the motor 57.

Further, in the first embodiment, the upstream transporting roller 511 (roller 5110) is rotated in both the CW and CCW directions; however, may be static during the curl correcting amount adjustment, similarly to the transporting roller 512 (rollers 5120, 5122).

Further, in the first embodiment, the eccentric cam 562 provided in the rotation shaft 561 is used for adjusting the curl correcting amount; however, instead of the eccentric cam 562, an abutting portion may be erected in the rotation shaft 561, and in accordance with the rotation phase position of the rotation shaft 561, the abutting portion may press against the abutting portion 54*a* of the guiding member 54 to thereby rotate the guiding member 54 around the swinging shaft 540.

Although the present invention has been described and illustrated in detail, it is clearly understood that the same is by way of illustration and example only and is not to be taken by way of limitation, the spirit and scope of the present invention being limited only by the terms of the appended claims. Further, it is intended that the scope of the present invention includes meanings equivalent to the scope of claims and all the changes within the scope thereof.

What is claimed is:

1. A curl correcting apparatus, comprising:

a curl correcting portion that has a first roller and a second roller which are arranged in parallel to each other in a pressure-contact state and which are different in hardness;

an adjusting portion that includes an adjustment rotation shaft having an abutting portion and that adjusts a distance to the first roller as a result of the abutting portion pressing against, in accordance with a rotation amount of the adjustment rotation shaft, the second roller;

a rotary driving portion capable of rotating in forward and reverse directions; and a clutch portion that transmits a rotary driving force of the rotary driving portion to the first roller during the forward rotation so as to rotate the first roller around a rotation shaft of the first roller and to the adjustment rotation shaft during the reverse rotation so as to rotate the adjustment rotation shaft.

2. The curl correcting apparatus according to claim 1, wherein the abutting portion of the adjusting portion includes an eccentric cam.

3. The curl correcting apparatus according to claim 1, characterized in that the second roller is supported by a transportation guiding portion, and the adjusting portion adjusts a distance to the first roller via the transportation guiding portion.

4. The curl correcting apparatus according to claim 1, characterized in that a hardness of the first roller is lower than a hardness of the second roller.

5. The curl correcting apparatus according to claim 1, wherein in the adjustment rotation shaft, a detection piece is provided which rotates together with the adjustment rotation shaft, and the curl correcting apparatus further comprises:

an optical sensor; and a rotation amount control means that detects, on the basis of output of the optical sensor, whether there is at least the detection piece to control a rotation amount of the adjustment rotation shaft.

6. The curl correcting apparatus according to claim 1, wherein the clutch portion includes a first one-way clutch and a second one-way clutch, in the first one-way clutch, a first input shaft is linked to the rotary driving portion, a first output shaft is linked to the first roller, characterized in that in the second one-way clutch, a second input shaft is linked to the first input shaft, and a second output shaft is linked to the adjustment rotation shaft.

7. The curl correcting apparatus according to claim 1, wherein the clutch portion includes a one-way clutch, characterized in that in the one-way clutch, an input shaft is linked to the rotary driving portion and an output shaft is linked to the adjustment rotation shaft.

8. An image forming apparatus, comprising:

the curl correcting apparatus according to claim 1; and a drive controlling portion that rotates forwardly the rotary driving portion during transportation of a recording paper and rotates reversely the rotary driving portion during curl correcting amount adjustment.

* * * * *